US006622820B2

(12) United States Patent
Pavlovic

(10) Patent No.: US 6,622,820 B2
(45) Date of Patent: Sep. 23, 2003

(54) POP SHIELD FOR MICROPHONE

(75) Inventor: Gino Pavlovic, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 0 days.

(21) Appl. No.: 09/909,463

(22) Filed: Jul. 19, 2001

(65) Prior Publication Data

US 2002/0017424 A1 Feb. 14, 2002

(30) Foreign Application Priority Data

Jul. 20, 2000 (AT) ..... 1274/00

(51) Int. Cl.[7] ..... F01N 7/08
(52) U.S. Cl. ..... 181/242
(58) Field of Search ..... 181/242, 240, 181/241, 243

(56) References Cited

U.S. PATENT DOCUMENTS 3,619,517 A * 11/1971 Bleazey ..... 381/176
4,600,077 A 7/1986 Drever
4,967,874 A * 11/1990 Scalli ..... 181/158
5,808,243 A * 9/1998 McCormick et al. ..... 181/0.5

* cited by examiner

*Primary Examiner*—Kimberly Lockett
(74) *Attorney, Agent, or Firm*—Friedrich Kueffner

(57) ABSTRACT

A pop shield for a microphone, the microphone having a housing and an electroacoustic transducer arranged in the housing and having a main voice input direction in an axial direction of the housing, is in the form of a cover of a first open-pore foam. The cover and the housing together enclose the electroacoustic transducer. The cover has, at least in the main voice input direction, two foam layers spaced apart from one another and defining a space therebetween.

6 Claims, 1 Drawing Sheet

POP SHIELD FOR MICROPHONE

BACKGROUND OF THE INVENTION

1. Field of the Invention

The invention relates to a pop shield for microphones, comprising a housing in which an electroacoustic transducer is arranged and a cover of an open-pore foam which, together with the housing, at least substantially encloses the electroacoustic transducer. In this connection, the invention particularly, but not exclusively, relates to microphones having a pop shield as an integral part thereof, i.e., arranged within their housing or a cage cover.

2. Description of the Related Art

The human speech has a number of so-called pop noises such as the letters p, t, k but also b and d which are characterized in that, even when they are pronounced with normal volume, they produce a sharp or sudden pressure wave. When this sound wave impacts on the diaphragm of the microphone, it causes an extreme or violent membrane movement and thus an overloading of the amplifier connected to the microphone. When playing back such a recording, this is recognizable as an unpleasant pop or plop noise.

In order to avoid this effect, according to the prior art a cover or shield is provided, usually made of foamed plastic material (referred to in the following as foam), that surrounds the diaphragm of the microphone, and, furthermore, a metal cage positioned externally and closely hugging the foam is provided as a mechanical protection of the foam as well as of the diaphragm. In other designs, a ball-shaped (spherical) or cube-shaped configurations of foam is placed onto the microphones, in particular, in the case of microphones which are used for on-site reporting. Tests have shown that such covers, which are simply slip on and are also referred to as wind screens, have no great efficiency. In the case of real wind screen devices, which are comprised of sleeves of foam and a fur-like coating arranged externally thereon, this is however different; these devices are indeed able to prevent wind noises and pop or plop noises occurring similar to wind noises.

It is known from U.S. Pat. No. 4,600,077 to provide an envelope for such external wind screen devices that are independent of the microphone. Such envelope is configured to surround the entire microphone and forms a net-like housing which is coated with suitable materials, in the aforementioned case, laminated fabric, in several layers.

In the case of studio microphones, where highest recording fidelity is to be observed and where the entire surroundings must be configured such that the best possible recording and transmission quality is ensured, no covers are used for the microphone capsule or diaphragm in order to prevent any type of distortion of the recording; instead, between the speaker and the microphone a corresponding mesh-like barrier is provided which fulfills the same task but is much more effective and has fewer side effects. Wind noises are, of course, not present in the studio so that indeed only the prevention of the pop noises must be ensured.

SUMMARY OF THE INVENTION

All of the aforementioned measures for preventing the pop noises have different disadvantages. For example, the foam envelopes or covers are either not really effective or, the more effective they are, the more they change the directional characteristic of the microphone and thus dampen its output level. The shields which are used in the studio are entirely unsuitable for use outside the studio, and there is therefore a need to provide an improvement of the pop shield, wherein particularly the occurrence of pop noises for direct voice input into the microphone at very close range is to be prevented without considerably affecting the output level, directional characteristic and frequency course of the microphone.

In accordance with the present invention, this is achieved in that the pop shield, at least in the main voice input direction of the microphone, is divided into two envelopes which are spaced apart from one another.

For microphones which are mostly used for voice input in one direction (for example, for rod-shaped lapel microphones in the axial direction), it is in this connection sufficient to provide between the speaker and the diaphragm, when viewed in the axial direction, two protective layers with an air space positioned therebetween wherein for a microphone that is to receive voice input from all directions an inner protector and an outer protector are preferably provided.

The invention is based on the recognition that the conventional pop shield covers, even when the wall thickness is increased, provide no considerable improvement of the pop shield effect but, instead, the output level, directional characteristic, and frequency course are changed. In comparison to conventional pop shield covers, the wall thickness can be considerably reduced without reducing be obtained pop shield effect.

It was surprisingly found that upon arranging two such covers at a spacing from one another an extreme improvement of the pop shield effect occurs without considerably changing or dampening the output level of the microphone or its directional characteristics and frequency course. The invention enables a significant improvement of the object of the invention by using pop shields or covers which, with regard to their total thickness, are hardly changed but are separated into two layers which are spaced from one another, wherein the spacing between the layers of the pop shield can be viewed as the important feature of the invention.

DESCRIPTION OF THE PREFERRED EMBODIMENTS

Figure 1:
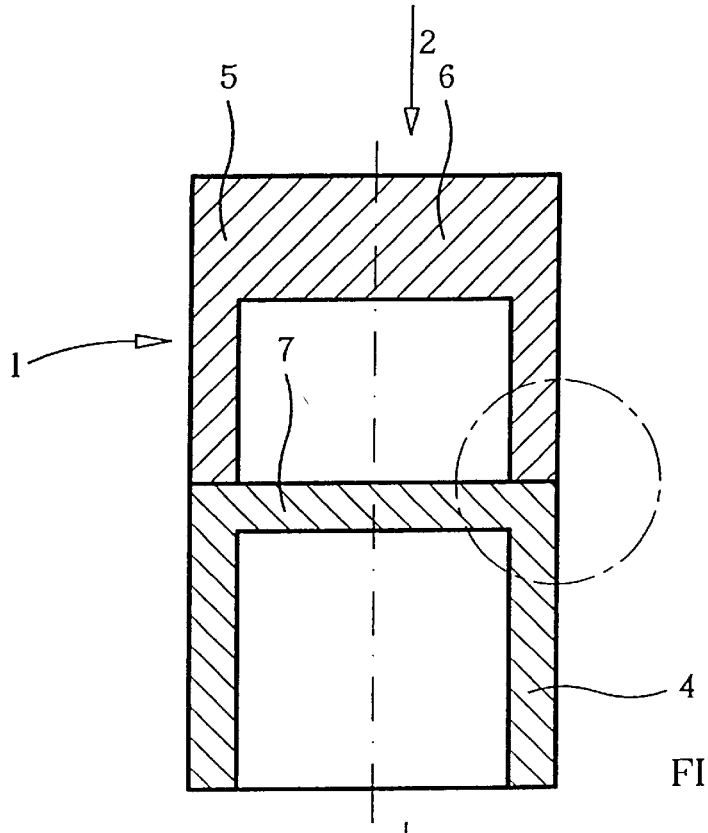
FIG. 1 schematically shows a first embodiment of a pop shield according to the invention, wherein the pop shield is represented as a cover of a microphone having substantially a single voice input direction which is the axial direction.

The cover, which in its entirety is referenced by reference numeral 1, is provided for a microphone, not illustrated, into which voice is input preferably substantially only in the direction of arrow 2. Such microphones are conventionally used particularly for interviews but can also be used for other purposes. Conventionally, in such microphones a microphone diaphragm is positioned in a plane which is substantially perpendicular to an axis 3 which is usually the microphone axis and coincides substantially with the main voice input direction 2.

FIG. 1 shows the cover or pop shield according to the invention as being comprised of two foam parts 4 and 5 wherein the part 4 corresponds substantially to the cover according to the prior art even though it is modified somewhat in a way to be explained in the following. A further similarly configured foam part 5 is placed onto the foam part 4 wherein its most important surface when using the microphone is the end face 6 which is arranged similar to a shield (umbrella) between the speaker and the microphone. Parallel thereto an end face 7 of the foam part 4 is provided wherein the two end faces 6, 7 are spaced apart at a distance from one another and an air space with distance L is positioned in the main voice input direction of arrow 2 between the two surfaces. It is not of such great importance that the mantle surfaces of the forward foam part 5 form a closed air space in this area; more important is the fact that the end faces 6 and 7 have a spacing from one another.

Figure 1A:
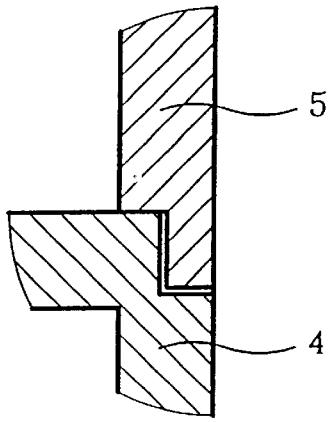
FIG. 1*a* shows a detail of the surfaces of the foam parts connected to one another by an adhesive.

As an auxiliary Figure to FIG. 1, FIG. 1*a* shows a detail illustrating a preferred connection between the two foam parts 4 and 5. This is an enlarged detail of the adhesive connection, wherein a stepped configuration is provided in order to enlarge the surface area for the adhesive connection and to facilitate centering of the parts 4, 5.

Figure 2:
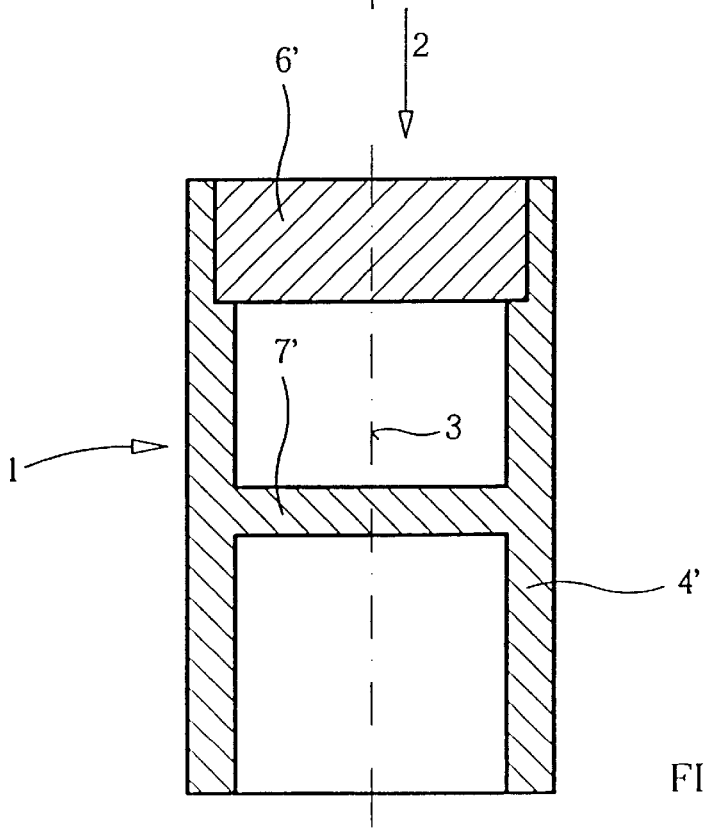
FIG. 2 shows a second embodiment of a pop shield according to the invention.

A somewhat different embodiment is illustrated in FIG. 2. The foam body 4' has a cross-sectional shape of an H, wherein, in reality, it is thus of a cylindrical shape with an integrally formed intermediate bottom 7'. This is so because instead of the complete cover 5 in FIG. 1, only an end piece 6' is inserted into the foam body 4'. For facilitating centering and the connection of the parts, the insert is provided with a stepped wall thickness so that the foam body 4' provides a stop for the end piece 6'.

The two foam bodies 4, 5 or 4', 6' can be comprised of different materials, and these can be easily selected by a person skilled in the art based on general knowledge in the art. In this connection, the physical action of such pop shields is to be explained briefly.

These covers (shields) are comprised of open-pore foam in which the connections between the individual hollow spaces of the pores provide sound travel distances of different lengths between two oppositely positioned surfaces of such a foam body. When a sound wave impacts in the form of a pressure front onto a surface of a foam body, the sound which enters the foam body at one side has no longer the character of a pressure front when exiting at the opposite side because of the different lengths of the individual paths of the sound; instead, the sound exits from different channels with time delay.

Since the pores of the open-pore foam bodies naturally are also networked or linked in the transverse direction, the sound travel paths through the foam are not discrete and separate from one another but form a complete, often branched and rejoined bundle of sound channels. These inner connections may be the reason that with increasing thickness of the foam body no further improvement can be observed because the initial effect of the different running times by means of these transverse connections is not enhanced anymore but instead more superposition and more damping occur.

When according to the invention two relatively thin layers of foam are spaced at a distance from one another, a sound wave is produced in the air-filled intermediate space after passage of the sound wave through the first layer and is comprised of different superpositions and combinations which, however, no longer is a pressure front because in the intermediate space the impact waves of different phases as a sum total have neutralized one another, and the resulting sound wave now reaches another thin foam body in which it is subjected again to the effect of the different running times within the foam body. This is significantly more effective than the use of a single but correspondingly thicker layer.

It is also possible according to the invention to fill the intermediate space between the foam layers completely or partially with a foam (as a spacer or filler) which foam is of a more open-pore configuration than the foam layers. For example, the foam layers 4 and 5 are comprised of foam of 80 ppi (pores per inch) while the spacer is comprised of a foam with 20–40 ppi. Generally, foams are to be used having 60–100 ppi, in particular, polyurethane foam.

As can be taken from the above discussion, it is possible, and even desirable, in regard to microphones with a spherical characteristic, where there is accordingly no preferred input direction, to employ two substantially concentrically arranged envelopes or covers, which, of course, must not be spherical, in order to obtain the same effect as with the described embodiment of a microphone with strong directional characteristic.

The foam material to be used for the pop shield according to invention can be open-pore foams that are currently conventionally used for such pop shields. Mounting on the microphone is carried out in the way known in the prior art. Also, the attachment of a protective cage, if this is desired, is carried out in the way known in the art. The connection of the two foam parts with one another is realized with suitable commercially available adhesives which are matched to the foam materials to be used and which are known to a person skilled in the art of foam materials and their use.

While specific embodiments of the invention have been shown and described in detail to illustrate the inventive principles, it will be understood that the invention may be embodied otherwise without departing from such principles.

What is claimed is:

1. A pop shield for a microphone, the microphone having a housing and an electroacoustic transducer arranged in the housing and having a main voice input direction in an axial direction of the housing, wherein the pop shield is a cover comprised of a first open-pore foam, wherein the cover and the housing together enclose substantially completely the electroacoustic transducer, wherein the cover comprises at least in the main voice input direction two foam layers spaced apart from one another and defining a space therebetween.

2. The pop shield according to claim 1, wherein the space is at least partially filled with a second open-pore foam, wherein the second open pore foam has fewer pores per inch than the first open-pore foam.

3. The pop shield according to claim 2, wherein the second open-pore foam has 20 to 40 ppi (pores per inch).

4. The pop shield according to claim 1, wherein the first open-pore foam has 60 to 100 ppi (pores per inch).

5. The pop shield according to claim 4, wherein the first open-pore foam has 80 ppi.

6. The pop shield according to claim 1, wherein the first and second open-pore foams are polyurethane foams.

* * * * *